United States Patent [19]

della Porta et al.

[11] Patent Number: 4,961,040

[45] Date of Patent: Oct. 2, 1990

[54] HIGH YIELD PAN-SHAPED GETTER DEVICE

[75] Inventors: Paolo della Porta; Daniele Martelli; Giuseppe Urso; Stefano Trivellato, all of Milan, Italy

[73] Assignee: SAES Getters SpA, Milan, Italy

[21] Appl. No.: 338,160

[22] Filed: Apr. 14, 1989

[30] Foreign Application Priority Data

Apr. 20, 1988 [IT] Italy ..... 20261 A/88

[51] Int. Cl.[5] ..... H01J 29/94; H01J 7/18

[52] U.S. Cl. ..... 313/561; 313/481; 417/48

[58] Field of Search ..... 313/481, 561; 417/48

[56] References Cited

U.S. PATENT DOCUMENTS

| | | | |
|---|---|---|---|
| 3,023,883 | 3/1962 | Meisen | 417/48 |
| 3,211,280 | 10/1965 | Malloy | 417/48 |
| 3,385,420 | 3/1968 | Della Porta | 417/48 |
| 3,428,168 | 2/1969 | Reash | 313/481 X |
| 3,457,448 | 7/1969 | Scott | 313/481 X |
| 3,558,962 | 1/1971 | Reasch . | |
| 3,560,788 | 2/1971 | Reasch | 313/561 |
| 3,920,355 | 11/1975 | Zucchinelli | 313/561 X |
| 4,128,782 | 12/1978 | Fransen et al. | 313/561 |
| 4,642,516 | 2/1987 | Ward et al. | 313/481 |

FOREIGN PATENT DOCUMENTS 898505 6/1962 United Kingdom .

*Primary Examiner*—Palmer C. DeMeo
*Attorney, Agent, or Firm*—David R. Murphy

[57] ABSTRACT

An evaporable getter device for mounting in an electron tube is provided which comprises a pan-shaped container having a vertical side wall formed around the perimeter of a disc shaped bottom wall and a pulverized getter metal vapor releasing material pressed into the space formed by said side wall and said bottom wall.

There is also provided a first heat transfer retarding means which delays the transfer of heat in a circumferential direction through the getter metal vapor releasing material. There is also provided a second heat transfer retarding means which delays the transfer of heat in a radial direction through the getter vapor releasing material. When the getter device is heated by currents induced from a radio frequency field created by a coil positioned outside the tube, opposite the getter device, high yields of getter metal are released in a short time without detachment of the getter material residues from the container.

16 Claims, 2 Drawing Sheets

FIG. 4
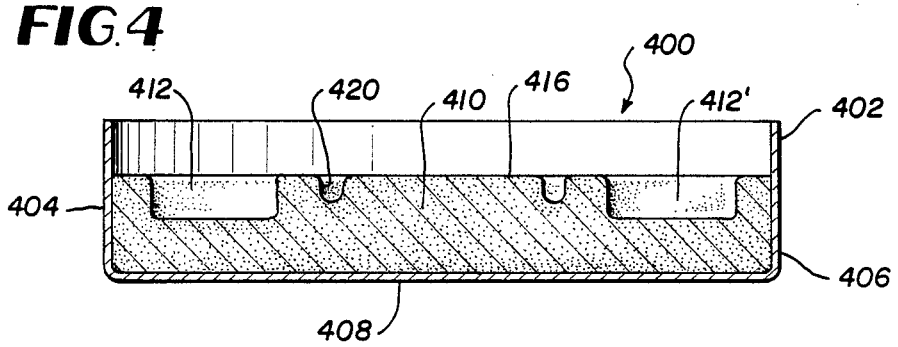
FIG. 5
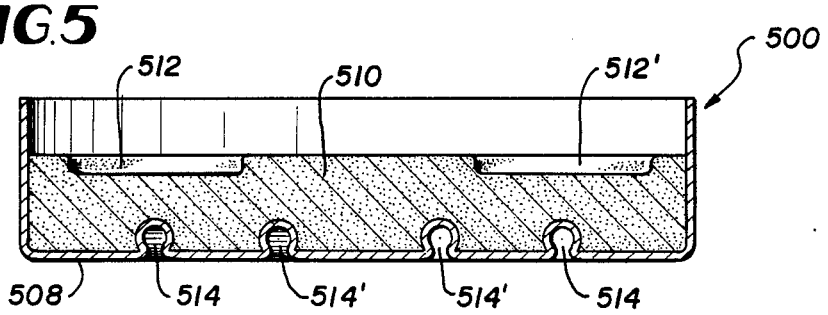
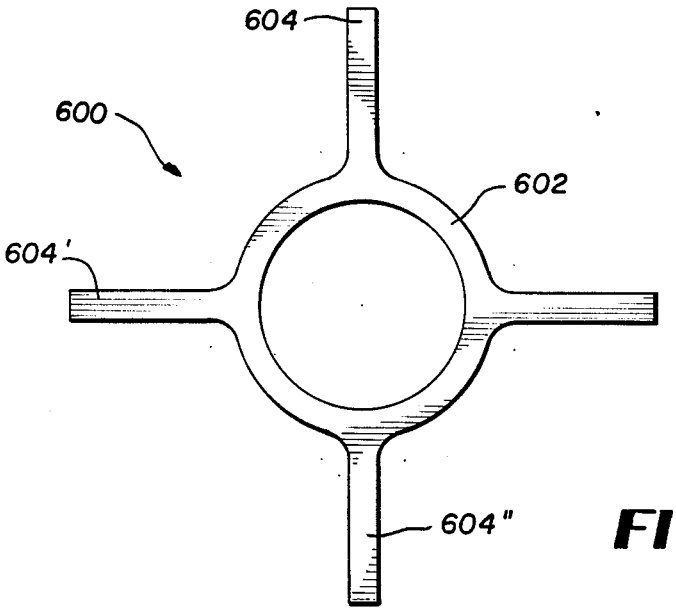
FIG. 6

HIGH YIELD PAN-SHAPED GETTER DEVICE

BACKGROUND TO THE INVENTION

Evaporable getter devices for mounting in electron tubes are well known in the art.

See for example UK Patent No. 898,505 and U.S. Pat. Nos. 3,023,883; 3,211,280 and 3,920,355. These getter devices have a U-shaped cross section and generally yield a quantity of getter material frequently barium, which is less than about 100 mg. With the introduction of larger sized electron devices or television picture tubes it has been found necessary to increase the quantity of getter material evaporated from a getter device. Getter devices capable of releasing larger quantities of getter material have been described for instance in U.S. Pat. Nos. 3,428,168; 3,457,448 and 4,642,516. These getter devices can release from about 125 mg to 230 mg of getter material. They employ the concept of a U-shaped channel container which however has a relatively large channel width. The use of such wide channels has lead to the necessity of preventing detachment of the getter metal vapour releasing material from the channel as is dramatically shown in U.S. Pat. No. 3,457,448 FIGS. 6 and 7. The above three patents try to overcome such disadvantages in these U-shaped cross-section getter devices.

Even larger sized tubes require even greater quantities of getter material. Attempts to provide such large quantities of getter materials such as 400 mg or more have been described in U.S. Pat. Nos. 3,558,962 and 3,560,788. See also FIGS. 9 and 10 of U.S. Pat. No. 3,385,420.

While pan-shaped getters such as those described in U.S. Pat. Nos. 3,558,962 and 3,560,788, mentioned above, have proved capable of giving yields of up to about 400 mg of barium with a release of about 80 to 85% of the barium content, they present certain disadvantages.

U.S. Pat. No. 3,558,962 described a pan-shaped getter in which is inserted a screen which acts as a reinforcing means to hold the getter residue in the container after flash. The screen is also said to conduct heat into the central mass of getter material. Unfortunately the addition of this screen causes a substantial increase in the total mass of the getter device comporting the known disadvantages inherent therein. In addition the screen structure forms closed electrical circuits in the external periphery of the getter device such that when the radio frequency induction heating is applied, overheating takes place in localized areas which can provoke melting of the getter container walls.

An alternative structure of a pan-shaped getter device has been described in U.S. Pat. No. 3,560,788 which however presents the same inconveniences. Furthermore the external wall is fabricated separately from the bottom wall. This leads to additional manufacturing expenses in attaching the two components together, and furthermore it is necessary to add yet another component in the form of a disc adjacent to the separate bottom wall.

If the intensity of the RF induced currents are reduced to try to avoid the melting problem then it is found that a long time elapses before the getter metal starts to evaporate (start time) and excessively long times are required to ensure evaporation of a sufficient quantity of getter metal (total time).

Furthermore the getter devices described in both U.S. Pat. Nos. 3,558,962 and 3,560,788 refer to getter devices having an outer wall diameter of 25 mm. When it is necessary to use a getter device with a smaller outer diameter and having the same high yield of getter material the above mentioned disadvantages remain.

OBJECTS OF THE PRESENT INVENTION

It is therefore an object of the present invention to provide a pan-shaped getter device free from one or more of the disadvantages of prior pan-shaped getter devices.

It is another object of the present invention to provide a pan-shaped getter device having a minimum total mass.

It is yet another object of the present invention to provide a pan-shaped getter device which does not exhibit melting of the getter container walls.

It is a further object of the present invention to provide a pan-shaped getter device having a high yield of getter material.

It is yet a further object of the present invention to provide a pan-shaped getter device which does not require long start times or total times for getter material evaporation.

These and other objects and advantages of the present invention will become apparent to those skilled in the art by reference to the following detailed description thereof and drawing wherein:

BRIEF DESCRIPTION OF THE DRAWINGS

FIG. 4 is a cross section of another embodiment of a pan-shaped getter device of the present invention.

FIG. 5 is a cross section of yet another embodiment of a pan-shaped getter device of the present invention.

FIG. 6 is a plan view of a combined first and second heat retarding means of the present invention.

DESCRIPTION OF THE INVENTION

Figure 1:
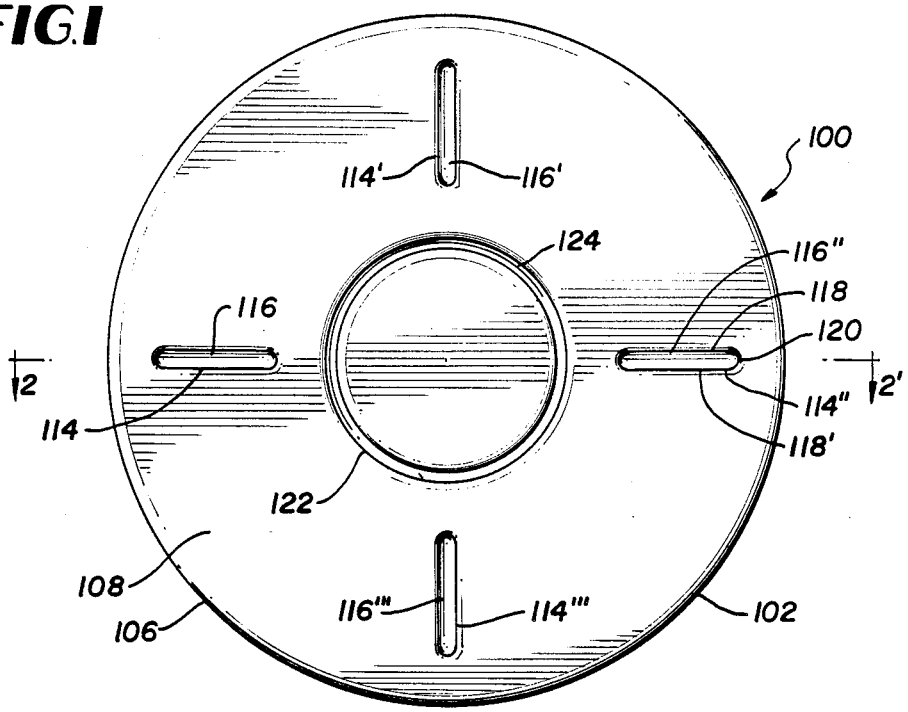
FIG. 1 is a bottom view of one embodiment of a pan-shaped getter device of the present invention.
Figure 2:
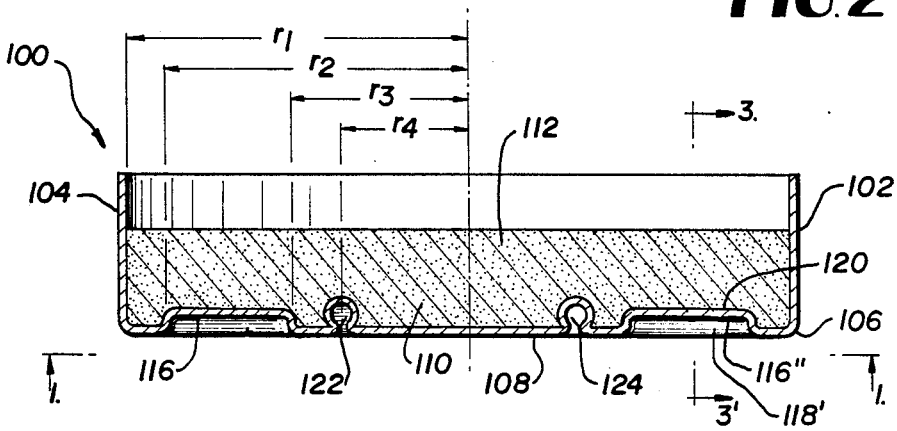
FIG. 2 is a cross section taken along line 2—2' of FIG. 1.
Figure 3:
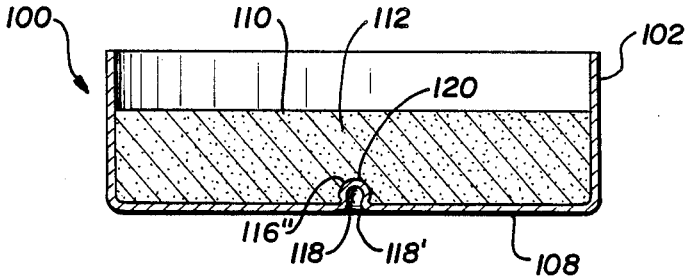
FIG. 3 is a cross section taken along line 3—3' of FIG. 2.

Referring now to FIGS. 1, 2 and 3 in which identical parts are identified with identical numbers there is shown a pan-shaped evaporable getter device 100 for mounting in the funnel portion of an electron picture tube against a wall thereof for discharging large quantities of barium getter metal into the tube interior. Getter device 100 comprises a pan-shaped container 102 which is preferably stainless steel. Pan-shaped container 102 comprises a vertical side wall 104 formed around the perimeter 106 of a disc shaped bottom wall 108. Pan-shaped container 102 contains a getter metal vapour releasing material 110. Getter metal vapour releasing material 110 preferably releases barium getter metal vapours upon heating, and comprises a $BaAl_4$ intermetallic compound and nickel in a weight ratio of approximately 1:1 pressed into the space 112 formed by said vertical side wall 104 and said bottom disc shaped wall 108. The getter metal vapour releasing material and nickel are preferably in the form of powder as is well known in the art.

The term "getter metal vapour releasing material" as used in the specification and claims herein is meant to include both the material prior to and after getter metal vapour release. This term embraces both the material in the form sold with the getter device and in the form in which it is found in an operating tube wherein the bulk of the getter metal has been evaporated from the material and is in the form of a film on the inside surfaces of the tube.

Pan-shaped evaporable getter device 100 is provided with a plurality of first heat transfer retarding means 114, 114', 114'', 114'''. It appears that such heat retarding means are able to somehow control or delay the transfer of heat in a circumferential direction through said getter metal vapour releasing material 110 and prevent excessive mechanical stresses and strains which could lead to the detachment of getter metal vapour releasing material 110 from the container. As shown in FIG. 1 the plurality of first heat transfer retarding means comprises four equally spaced radial grooves, 116, 116', 116'', 116''' having a length longer than their width. Grooves 116, 116', 116'', 116''', have a generally open shaped cross-section and may have the contour of a half sine wave or may have an open bulb shaped cross-section. The bulb shaped cross-section may narrow down adjacent to said disc shaped bottom wall 108. Preferably radial grooves 116, 116', 116'', 116''' have side walls 118, 118' (detailed only for radial grooves 116'' of FIG. 3). Furthermore radial grooves 116, 116', 116'', 116''' further comprise a curved upper radial joining wall 120. Radial grooves 116, 116', 116'', 116''' penetrate into the space formed by vertical side wall 102, and disc shaped bottom wall 108. In addition pan-shaped getter device 100 is provided with a second heat transfer retarding means 122 which apparently delays the transfer of heat in a radial direction through the getter metal vapour releasing material 110 and like the first heat retarding means effectively prevents excessive stresses and strains between the getter metal vapour releasing material and the container which could otherwise lead to detachment of the getter metal releasing material 110. As shown in FIGS. 1, 2 and 3, second heat transfer retarding means 122 comprises an annular groove 124 integrally formed in disc-shaped bottom wall 108. Annular groove 124 has a generally bulb shaped cross section which narrows down adjacent to said disc shaped bottom wall. Annular groove 124 penetrates into the space 112 formed by vertical side wall 104 and bottom wall 108. Thus the transfer of heat in a circumferential direction and in a radial direction through getter metal vapour releasing material 110 is retarded when the getter device 100 is heated by current induced from an RF field created by a coil positioned outside the tube opposite the getter device 100.

The number of radial grooves which comprise the plurality of first heat transfer retarding means may be any number which is sufficient to sufficiently delay the transfer of heat in a circumferential direction. It has been found that the number of radial grooves should preferably be from 3 to 8. If there are less than 3 radial grooves then there is insufficient retarding of heat in the circumferential direction with a subsequent ejection of getter metal vapour releasing material particles from the getter device. If the number of grooves is greater than 8 then there is too great a heat retarding effect in the circumferential direction with a subsequent loss of barium metal vapour quantities in sufficiently short time. The number of second heat transfer retarding means provided may be any number which is sufficient to delay the transfer of heat in a radial direction to the getter metal vapour releasing material. However it has been found that either one or two second heat transfer retarding means may be used. Excessive difficulties are found in manufacturing the pan-shaped container if more than two second heat transfer retarding means were to be attempted to be used.

In the embodiment of pan-shaped evaporable getter device 100 the radius $r_4$ of annular groove 124 should preferably be less than 50% of the radius $r_1$ of container 102. If radius $r_4$ is substantially greater than about 50% of $r_1$ then there is insufficient space for the provision of the plurality of first heat transfer retarding means 114, 114', 114'', 114'''.

Referring now to FIG. 4 there is shown an alternative embodiment of an evaporable-getter device 400 of the present invention. Evaporable getter device 400 comprises a pan-shaped container 402, preferably of stainless steel and comprises a vertical side wall 404 formed around the perimeter 406 of a disc shaped bottom wall 408. In alternative embodiment of evaporable getter device 400 there are first heat transfer retarding means to delay the transfer of heat in a circumferential direction through the getter metal vapour releasing material 410 in the form of a multiplicity of equally spaced radial grooves 412, 412'' compressed into upper surface 416 of getter metal vapour releasing material 410. A second heat transfer retarding means to delay the transfer of heat in a radial direction through the getter metal vapour releasing material 410 comprises an annular groove 420 also compressed into upper surface 416 of getter metal vapour releasing material 410.

It will be realized that other combinations of heat transfer retarding means may be used. For instance a getter device may be provided in which the first heat transfer retarding means to delay the transfer of heat in a circumferential direction through the getter metal vapour releasing material comprises a plurality of radial grooves compressed into the upper surface of the getter metal vapour releasing material whereas the second heat transfer retarding means to delay the transfer of heat in a radial direction through the getter metal vapour releasing material comprises at least one annular groove integrally formed in the disc shaped bottom wall. In this latter case if only one annular groove is provided its radius is not limited to less than 50% of the radius of the outer wall of the getter device as its position does not limit the radial extent of the radial grooves compressed into the upper surface of the getter metal vapour releasing material.

FIG. 5 shows a cross section of yet another embodiment of an evaporable getter device 500 of the present invention in which the first heat retarding means is in the form of radial grooves 512, 512' compressed into the getter metal vapour releasing material 510, and the second heat retarding means are two concentric bulb shaped annular grooves 514, 514' formed in the bottom wall 508.

Referring to FIG. 6 there is shown combined first and second heat transfer retarding means 600 which can be embedded within the getter metal vapour releasing material supported in a pan-shaped container (not shown). Combined first and second heat transfer retarding means comprises a substantially disc shaped member 602 having a diameter less than about half of the diameter of the outside vertical side wall of the pan-shaped container and a plurality of substantially equally spaced to radial spokes 604, 604', 604'', 604''', each having a length longer than its width.

The term "pan-shaped" as used herein means a getter device wherein the getter metal vapour releasing material extends substantially completely from one side wall to the opposite side wall. Thus annular getter devices having an open centre are not "pan-shaped" as that term is used herein.

EXAMPLE 1

A prior art pan-shaped getter device was manufactured according to U.S. Pat. No. 3,558,962 having an outside diameter of 25 mm and containing about 2000 mg of a 50% $BaAl_4$-50% Ni (by weight) powder mixture. Before placing the powder mixture into the pan-shaped holder there was inserted a stainless steel screen of 10×10 mesh. When the getter device was heated by RF heating in a vacuum environment the outer walls of the pan shaped holder melted and caused release of particles of the getter metal vapour releasing material. It was thus not possible to give any meaning to the amount of barium released. Furthermore, if the getter device were to have been heated in an electron device such as a cathode ray tube, the melting of the holder and release of getter metal vapour releasing particles would have provoked severe damage to internal components of the electron device.

EXAMPLE 2

A total number of 17 pan-shaped devices of the present invention were manufactured according to the embodiment shown in FIGS. 1, 2 and 3. The radius $r_2$ was 10 mm. There were provided four equally spaced radial grooves, integrally formed in the disc shaped bottom wall, each having a length greater than its width, each groove extending from a radius ($r_3$) of 4.25 mm to a radius of ($r_2$) 8.68 mm, each groove having substantially parallel sidewalls.

There was also provided an annular groove, integrally formed in the disc shaped bottom wall said annular groove having a generally bulb shaped cross section which narrowed down adjacent said disc shaped bottom wall. The radius of the annular groove was 3.38 mm (=34% of $r_1$). The pan-shaped container 102 held about 2000 mg of a 50% $BaAl_4$-50% Ni (by weight) powder mixture. (The average total Ba content being 477 mg). The getter devices were heated by RF heating in a vacuum environment and getter metal vapour Ba was released. The getter devices were heated for a total time of 40 seconds using different start times (the tim from application of RF heating to the moment when Ba starts to evaporate). From a graph of Ba yield (the weight of Ba evaporated) the following data were obtained

| Start Time Seconds | Ba Yield (mg) | % Yield |
|---|---|---|
| 12 | 440 | 92% |
| 13 | 400 | 84% |

The getter devices showed no signs of melting of the outer wall of the container and no ejection of loose particles of the getter metal vapour releasing material.

EXAMPLE 3

A pan-shaped getter device of the present invention was manufactured in accordance with the present invention and exactly similar to the getter devices of Example 1 with the sole exception that the four radial grooves were no longer integrally formed in the disc shaped bottom wall but were grooves in the upper surface of the getter metal vapour releasing material. On heating the getter device, by RF heating, in a vacuum environment for a total time of 40 sec. using a start time of 12 sec., 460 mg of Ba were released. This is 96% of the total Ba content.

The getter device showed no signs of melting of the outer wall of the container and no ejection of loose particles of the getter metal vapour releasing material.

EXAMPLE 4

A pan-shaped getter device of the present invention is manufactured according to the embodiment shown in FIG. 5. The radius $r_1$ was 10 mm. The pan-shaped container holds about 2000 mg of a 50% $RaAl_4$-50% (by weight) powder mixture. On heating the getter device there are no signs of melting of the outer wall of the container and no ejection of loose particles of the getter metal vapour releasing material.

Although the invention has been described in considerable detail with reference to certain preferred embodiments designed to teach those skilled in the art how best to practice the invention, it will be realized that other modifications may be employed without departing from the spirit and scope of the appended claims.

What is claimed is:

1. An evaporable getter device for mounting in an electron tube comprising a pan-shaped container having a vertical sidewall formed around the perimeter of a disc-shaped bottom wall and a pulverized getter metal vapour releasing material pressed into the space formed by said sidewall and said bottom wall and first heat transfer retarding means adapted to delay the transfer of heat in a circumferential direction through said getter metal vapour releasing material and second heat transfer retarding means adapted to delay the transfer of heat in a radial direction through the getter metal vapor releasing material when the getter device is heated by currents induced from an RF field created by a coil positioned outside the tube opposite the getter device in which said first heat transfer retarding means comprises a multiplicity of equally spaced radial grooves integrally formed in the disc shaped bottom wall at least partially penetrating into the space formed by said sidewall and said bottom wall.

2. A getter device of claim 1 in which the radial grooves have a length longer than their width.

3. A getter device of claim 1 in which the radial grooves have an open bulb shaped cross-section.

4. A getter device of claim 3 in which the bulb shaped cross section of radial grooves narrows down adjacent said disc shaped bottom wall.

5. A getter device of claim 1 in which said second heat transfer retarding means comprises at least one annular groove integrally formed in the disc shaped bottom wall and at least partially penetrating into the space formed by said sidewall and said bottom wall.

6. A getter device of claim 5 in which said annular grooves have a diameter less than half of the diameter of the outside vertical sidewall.

7. A getter device of claim 5 in which the annular grooves have an open bulb shaped cross section.

8. A getter device of claim 7 in which the bulb shaped cross section of the annular grooves narrows down adjacent said disc shaped bottom wall.

9. A getter device of claim 1 in which said first heat transfer retarding means comprises a multiplicity of equally spaced radial grooves compressed into the upper surface of said getter metal vapour releasing material at least partially penetrating into the space formed by said sidewall and said bottom wall.

10. A getter device of claim 9 in which said radial grooves have a length longer than their width.

11. A getter device of claim 1 in which said second heat transfer retarding means comprises at least one annular groove compressed into the upper surface of said getter metal vapour releasing material and at least partially penetrating into the space formed by said sidewall and said bottom wall.

12. A getter device of claim 11 in which said annular grooves have a diameter less than half of the diameter of the outside vertical sidewall.

13. A getter device of claim 1 in which said first and second heat transfer retarding means are in the form of a single metal insert embedded in the getter metal vapour releasing material, said single metal insert comprising a disc shaped member and a multiplicity of equally spaced radial spokes.

14. An evaporable getter device for mounting in the funnel portion of an electron picture tube against a wall thereof for discharging large quantities of barium getter metal into the tube interior comprising a stainless steel pan-shaped container having a vertical side-wall formed around the perimeter of a disc shaped bottom wall and, a pulverized barium getter metal vapour releasing material comprising a $BaAl_4$ intermetallic compound and Ni in a weight ratio of 1:1 pressed into the space formed by said sidewall and said bottom wall and, first heat transfer retarding means to delay the transfer of heat in a circumferential direction through said getter metal vapour releasing material comprising four equally spaced radial grooves, integrally formed in the disc shaped bottom wall, having a length longer than their width and an open cross section comprising two substantially parallel radial walls and a curved upper radial joining wall, penetrating into the space formed by said sidewall and said bottom wall and, second heat transfer retarding means in a radial direction through the getter metal vapour releasing material comprising an annular groove, integrally formed in the disc shaped bottom wall, said annular groove having a generally bulb shaped cross section which narrows down adjacent said disc shaped bottom wall, having a diameter less than half of the diameter of the outside vertical side wall and penetrating into the space formed by said sidewall and said bottom wall, wherein the delay occurs when the getter device is heated by currents induced from an RF field created by a coil positioned outside the tube opposite the getter device.

15. An evaporable getter device for mounting in the funnel portion of an electron picture tube against a wall thereof for discharging large quantities of barium getter metal into the tube interior comprising a stainless steel pan-shaped container having a vertical side-wall formed around the perimeter of a disc shaped bottom wall and, a pulverized barium getter metal vapour releasing material comprising a $BaAl_4$ intermetallic compound and Ni in a weight ratio of 1:1 pressed into the space formed by said sidewall and said bottom wall and, first heat transfer retarding means to delay the transfer of heat in a circumferential direction through said getter metal vapour releasing material comprising four equally spaced radial grooves, compressed into the upper surface of said getter metal vapour releasing material, having a length greater than their width at least partially penetrating into the space formed by a said sidewall and said bottom wall and, second heat transfer retarding means to delay the transfer of heat in a radial direction through the getter metal vapour releasing material comprising an annular groove, compressed into the upper surface of said getter metal vapour releasing material, having a diameter less than half of the diameter of the outside vertical side wall and at least partially penetrating into the space formed by said sidewall and said bottom wall, wherein the delay occurs when the getter device is heated by currents induced from an RF field created by a coil positioned outside the tube opposite the getter device.

16. An evaporable getter device for mounting in the funnel portion of an electron picture tube against a wall thereof for discharging large quantities of barium getter metal into the tube interior comprising a stainless steel pan-shaped container having a vertical side-wall formed around the perimeter of a disc shaped bottom wall and, a pulverized barium getter metal vapour releasing material comprising a $BaAl_4$ intermetallic compound and Ni in a weight ratio of 1:1 pressed into the space formed by said sidewall and said bottom wall and extending completely from one side wall to the opposite side wall and, first heat transfer retarding means to delay the transfer of heat in a circumferential direction through said getter metal vapour releasing material and, second heat transfer retarding means to delay the transfer of heat in a radial direction through the getter metal vapour releasing material, said first and second heat transfer retarding means being in the form of a single metal insert embedded in the getter metal vapour releasing material, said single metal insert comprising a disc shaped member having a diameter less than half of the diameter of the outside vertical sidewall and four equally spaced radial spokes having a length longer than their width, when the getter device is heated by currents induced from an RF field created by a coil positioned outside the tube opposite the getter device.

* * * * *